US010920410B2

(12) United States Patent
Wadaga et al.

(10) Patent No.: US 10,920,410 B2
(45) Date of Patent: Feb. 16, 2021

(54) TRENCH DRAIN PROVIDING VARIABLE DRAIN LOCATION AND INSTALLATION

(71) Applicant: Noble Manufacturing, LLC, Grand Haven, MI (US)

(72) Inventors: James Anthony Wadaga, Grand Haven, MI (US); Paul Kik, Sr., Hudsonville, MI (US)

(73) Assignee: Noble Manufacturing, LLC, Spring Lake, MI (US)

( * ) Notice: Subject to any disclaimer, the term of this patent is extended or adjusted under 35 U.S.C. 154(b) by 0 days.

(21) Appl. No.: 16/209,562

(22) Filed: Dec. 4, 2018

(65) Prior Publication Data

US 2019/0169831 A1 Jun. 6, 2019

Related U.S. Application Data

(60) Provisional application No. 62/594,173, filed on Dec. 4, 2017.

(51) Int. Cl.
*E03F 5/04* (2006.01)
*E03F 3/04* (2006.01)

(52) U.S. Cl.
CPC ..... *E03F 5/0408* (2013.01); *E03F 3/046* (2013.01); *E03F 5/0407* (2013.01); *E03F 5/0409* (2013.01); *E03F 2005/0415* (2013.01)

(58) Field of Classification Search
CPC ..... E03F 5/0407; E03F 5/0408; E03F 5/0409; E03F 3/046; E03F 2005/0415
USPC ..... 4/613, 679
See application file for complete search history.

(56) References Cited

U.S. PATENT DOCUMENTS

| | | | |
|---|---|---|---|
| 2,292,368 | A | 8/1942 | Gordon |
| 2,836,830 | A | 6/1958 | Norman |
| 3,139,627 | A | 7/1964 | Rice |
| 3,816,234 | A | 6/1974 | Winfield |
| 4,198,715 | A | 4/1980 | Daniels |
| 4,280,613 | A | 7/1981 | Stewart |
| 4,557,004 | A | 12/1985 | Piana |
| 4,571,751 | A | 2/1986 | Barlow |
| 4,844,944 | A | 7/1989 | Graefe et al. |
| 5,140,789 | A | 8/1992 | De Gooyer |

(Continued)

FOREIGN PATENT DOCUMENTS

| | | | |
|---|---|---|---|
| DE | 202006019811 | U1 | 6/2007 |
| EP | 2206456 | A2 | 7/2010 |

*Primary Examiner* — Tuan N Nguyen
(74) *Attorney, Agent, or Firm* — Price Heneveld LLP

(57) ABSTRACT

A trench drain apparatus includes a trench body and an insert that can be assembled to the trench body to adjustably locate a trench drain hole in the insert relative to a footprint of the trench body. This allows adjustment of the trench drain hole at the installation site, yet takes advantage of pre-manufactured components. An upper surface of the trench body may receive an optional waterproof membrane clamped onto the sealing surface by a clamp ring. The insert can be rotated 180 degrees prior to installation to provide two different drain hole locations, or can be cut on site at one or both ends so that the drain hole ends up at desired location optimally matching a pre-existing drainage pipe opening. Methods related to the above are also provided, including adjusting the insert to locate the trench drain hole at an optimal location.

19 Claims, 8 Drawing Sheets

(56) References Cited

U.S. PATENT DOCUMENTS

| | | | | |
|---|---|---|---|---|
| 5,243,716 | A * | 9/1993 | Zaccai | A47K 3/40 4/613 |
| 5,643,652 | A | 7/1997 | Maurer et al. | |
| 5,647,565 | A | 7/1997 | Wei | |
| 5,816,005 | A | 10/1998 | Han | |
| 5,845,347 | A | 12/1998 | Young | |
| 5,913,777 | A | 6/1999 | Gerber | |
| 6,077,613 | A | 6/2000 | Gaffigan | |
| 7,093,395 | B2 | 8/2006 | Hinault et al. | |
| D539,394 | S | 3/2007 | Luxton | |
| 8,230,535 | B2 | 7/2012 | Kik, Sr. et al. | |
| 8,474,068 | B2 | 7/2013 | Kik, Sr. et al. | |
| 9,596,961 | B2 | 3/2017 | Stokely et al. | |
| 2002/0124306 | A1 | 9/2002 | Smale | |
| 2003/0003271 | A1 | 1/2003 | Bykov et al. | |
| 2004/0182030 | A1 | 9/2004 | Hinault et al. | |
| 2007/0294954 | A1 | 9/2007 | Barrett et al. | |
| 2008/0016614 | A1 | 1/2008 | Daniels | |
| 2008/0222793 | A1 | 9/2008 | Cook | |
| 2008/0222794 | A1 | 9/2008 | Cook | |
| 2008/0222795 | A1 | 9/2008 | Cook | |
| 2008/0222796 | A1 | 9/2008 | Cook | |
| 2008/0222797 | A1 | 9/2008 | Cook | |
| 2008/0222891 | A1 | 9/2008 | Cook | |
| 2008/0276364 | A1 | 11/2008 | Barro et al. | |
| 2009/0119831 | A1 * | 5/2009 | Grave | A47K 3/40 4/613 |
| 2015/0067961 | A1 | 3/2015 | Adamson et al. | |

* cited by examiner

TRENCH DRAIN PROVIDING VARIABLE DRAIN LOCATION AND INSTALLATION

CROSS-REFERENCE TO RELATED APPLICATION

This application claims priority to and the benefit under 35 U.S.C. § 119(e) of U.S. Provisional Patent Application No. 62/594,173, filed on Dec. 4, 2017, entitled "TRENCH DRAIN PROVIDING VARIABLE DRAIN LOCATION AND INSTALLATION," by James Anthony Wadaga and Paul Kik, Sr., the entire disclosure of which is incorporated herein by reference.

BACKGROUND

The present invention relates to a trench drain apparatus adapted to provide a variable drain location that facilitates matching its drain hole to a drainage pipe at an installation site. The present invention is particularly useful in retrofit installations where the drainage pipe is already set. The present invention also includes methods of installation and of manufacturing. However, the present innovation is not believed to be limited to only on-site installations, nor limited to only retrofit installations.

It is known to use and install pre-manufactured components in showers, bathrooms, and in places where water and moisture are encountered and must be drained, such as indoor and outdoor commercial and residential and public/non-public locations, such as at hotels, institutions, other commercial and domestic buildings, homes and condominiums. For example, a problem often occurs in retrofit and upgrade situations because the location of the drainage pipe is already set and it is difficult to accurately match and align the (new) trench drain's hole with the drainage pipe location, especially when pre-manufactured components are used.

An improved system and method is desired that provides a variable drain location, with final adjustment preferably performed at an installation site, so that the drain's opening can be adequately closely aligned with the (existing) drainage pipe opening. A drain and a method of installation is desired that is flexible in configuration, flexible and adaptable to different drains and different floor designs, and allows an efficient and productive installation, yet minimizes installation time, and in particular minimizes the time needed from highly skilled installers thereby reducing installation cost.

SUMMARY OF THE INVENTION

In one aspect of the present invention, a trench drain apparatus comprises: a trench body having a foot print when in an installed position, the trench body defining a cavity that is upwardly and downwardly open when in the installed position; and an insert fitting into the cavity that defines a trench drain hole and that can be assembled to the trench body on site to adjustably locate the trench drain hole relative to the foot print of the trench body.

In another aspect of the present invention, an adjustable-drain-location-defining system for a moisture-laden environment with a floor drain comprises a body defining an oversized cavity that is upwardly and downwardly open when in an installed position; and an insert shaped to matingly and adjustably fit into the cavity, the insert defining a drain hole that can be selectively adjusted in position when the insert is assembled to the body.

In a narrower aspect of the present system, the trench body includes an upper surface configured to receive an optional waterproof membrane and an optional clamp seal for holding the waterproof membrane on the upper surface. The trench body further includes a sloped surface that extends toward the cavity for directing gravity-biased water toward the cavity.

In a narrower aspect of the present system, the cavity is elongated and the insert is similarly elongated so that the insert matingly fits into the cavity with outboard portions of the insert closely adjacent mating inboard portions of the trench body.

In a narrower aspect of the present system, the trench drain hole is offset from a center of the insert, and the insert can be positioned in the cavity in either of at least two different positions, which thus positions the trench drain hole in different locations relative to the footprint of the body. It will be appreciated, however, that the drain hole may nevertheless be centered in the insert.

In another aspect of the present invention, a method includes providing a trench body defining a footprint when installed and having a cavity that is upwardly and downwardly open when in the installed position; providing an insert defining a trench drain hole; and assembling the insert to the trench body to adjustably locate the trench drain hole relative to the foot print of the trench body.

In another aspect of the present invention, a method is provided for placing a drain opening in a desired location to match a drainage pipe. The method includes providing a body defining a footprint when installed and having a cavity that is upwardly and downwardly open when in the installed position; providing an insert defining a drain hole; adjustably assembling the insert to the body to adjustably locate the trench drain hole on the body; and coupling the insert to the body to form a leak-free assembly around the insert and the body.

An aspect of the present innovation is to provide a floor drain system with selective variable-location-drain-hole, where the system utilizes pre-manufactured components, yet allows on-site flexibility and variability in matching/aligning to a (pre-existing or pre-set) drainage pipe opening. The present apparatus can be useful in new constructions as well as upgrade and retrofit constructions.

These and other aspects, objects, and features of the present invention will be understood and appreciated by those skilled in the art upon studying the following specification, claims, and appended drawings.

BRIEF DESCRIPTION OF DRAWINGS

The present invention will become more fully understood from the detailed description and the accompanying drawings, wherein.

DETAILED DESCRIPTION OF PREFERRED EMBODIMENTS

Figure 1:
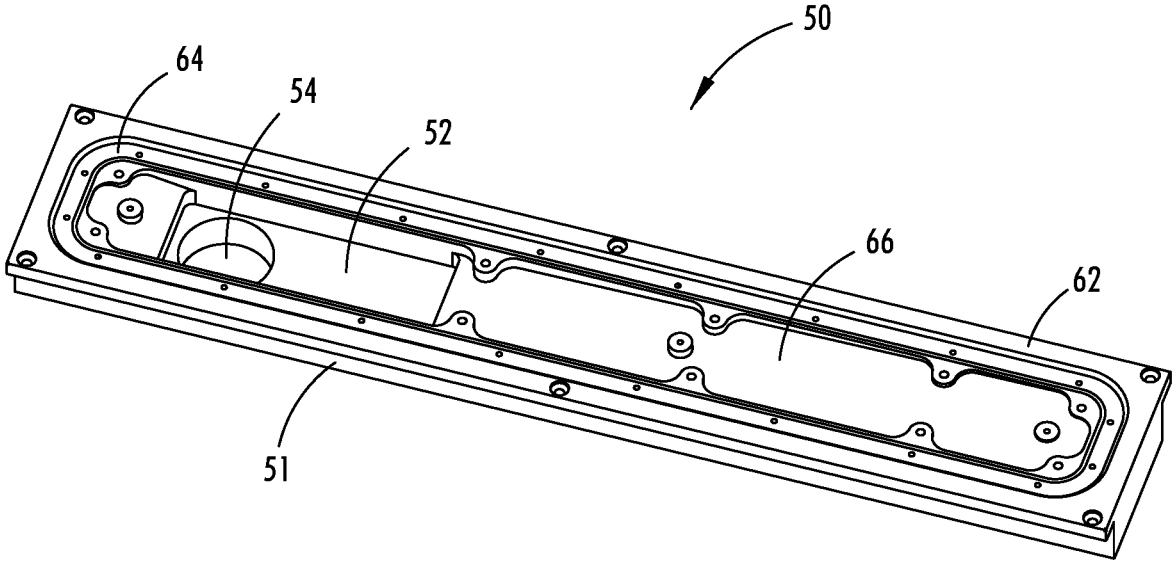
FIG. 1 is a perspective view of a trench drain apparatus (also called "adjustable drain hole system") embodying the present invention with the insert positioned in a first position.
Figure 1A:
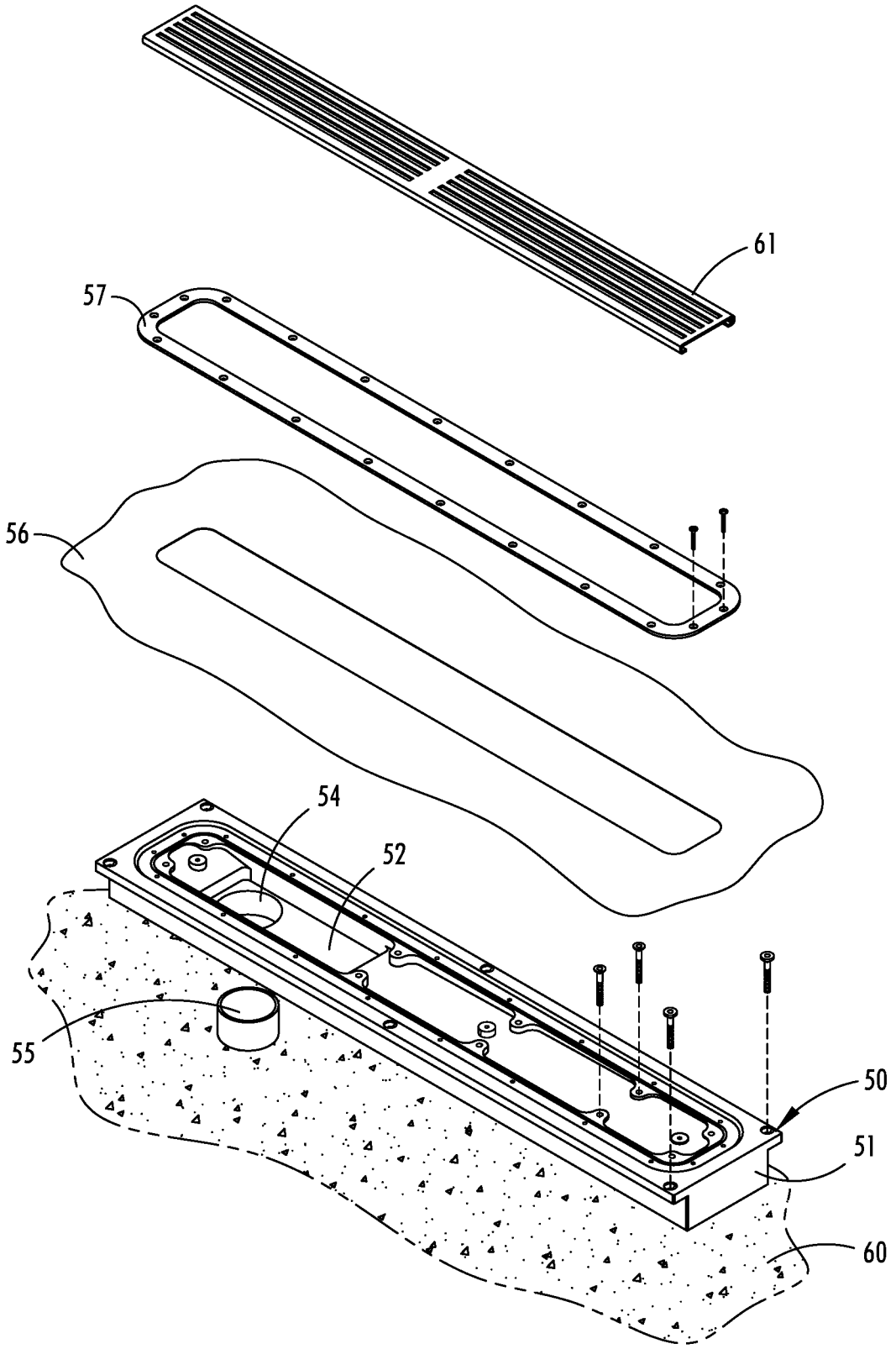
FIG. 1A is an exploded perspective view of the trench drain apparatus of FIG. 1 along with adjacent floor components such as the existing drainage pipe, an optional waterproof membrane, and an optional membrane clamp ring.

For purposes of description herein the terms "upper," "lower," "right," "left," "rear," "front," "vertical," "horizontal," and derivatives thereof shall relate to the device as oriented in FIG. 1A. However, it is to be understood that the device may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 10:
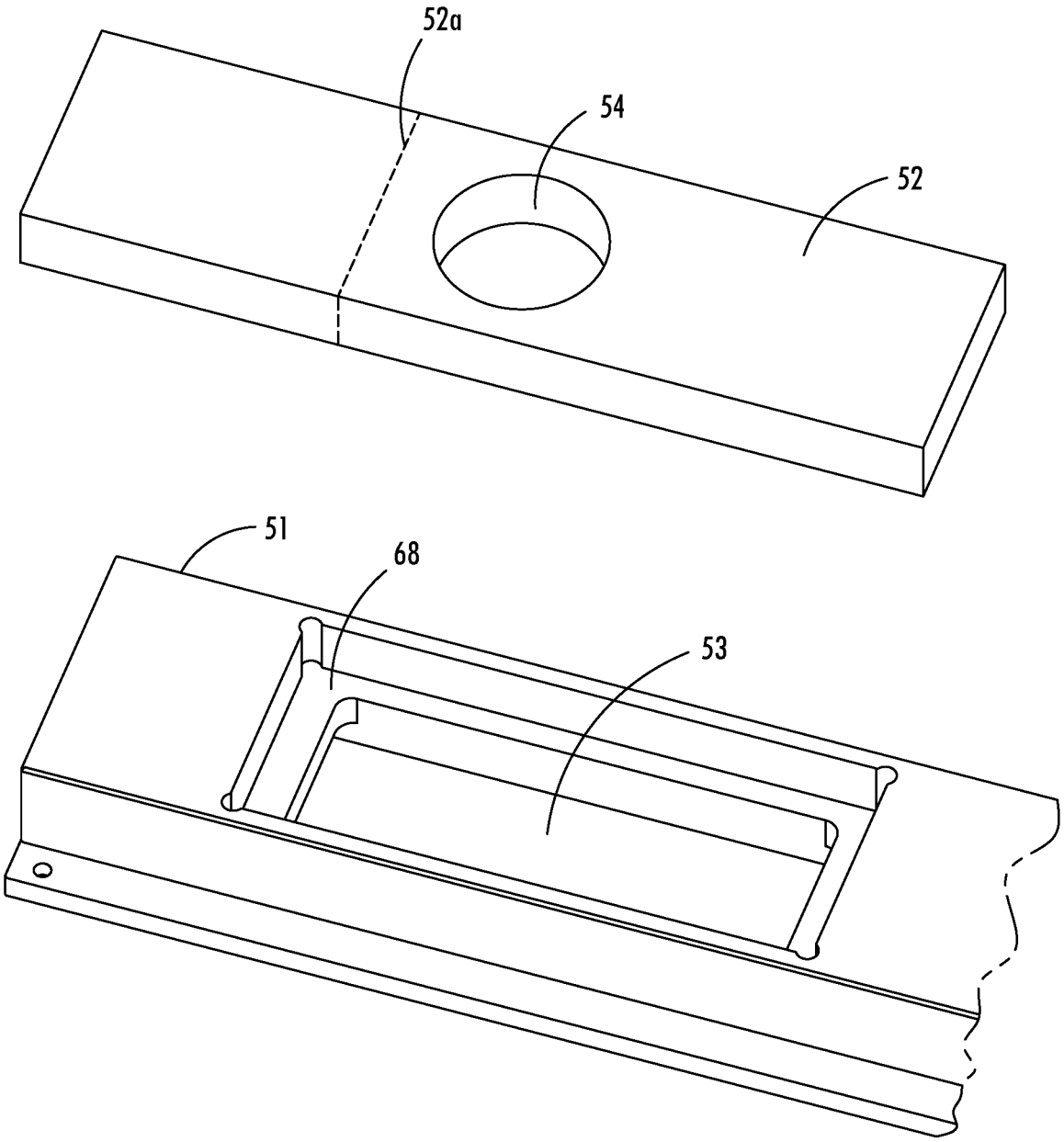
FIG. 10 is an enlarged view of a portion of the trench drain apparatus of FIG. 1 with an uncut insert (that is yet to be trimmed) positioned relative to the trench body.

FIGS. 1-10 show a trench drain apparatus 50 that includes a trench body 51 with a cavity 53, and a drain-hole-forming insert 52 with a trench drain hole 54. The insert 52 is shaped to be bonded in the cavity 53 to form a leak-free assembly with the trench drain hole 54 adjustably located as designed such as to align with a pre-set drainage pipe opening 55. The illustrated insert 52 can be placed in the cavity 53 in first or second orientations (one being 180 degrees from the other), which allows the trench drain hole 54 to be variably located during an on-site installation in either of two different positions to promote optimal alignment. Also, as shown in FIG. 10, the illustrated insert 52 can be manufactured to have a greater length than the cavity 53, so that one or both of its ends can be selectively cut (at cut line 52*a*) so that the trench drain hole 54 can be selectively located in an infinite number of positions for optimal alignment with the drainage pipe opening 55. Insert 52 would be bonded to trench body 51 to form a water tight bond.

As shown in FIG. 1A, the trench drain apparatus 50 may be positioned with the trench drain hole 54 engaging the drainage pipe opening 55 that is provided through a subfloor 60. The trench drain apparatus 50 is laid to rest on the subfloor 60 and may be screwed or glued in place. A shower base (not shown) may be provided around or adjacent to the trench drain apparatus 50. Then an optional waterproof membrane 56 may be laid over the shower base and the trench drain apparatus 50. An optional clamp ring 57 may then be secured to the trench body 51 to clamp the waterproof membrane 56 to the trench drain apparatus 50. Next, a hole may be cut in the waterproof membrane around the inner opening of the clamp ring 57. The clamp ring 57 may be configured to fit within the recess of a recessed ridge 64 formed in a top surface 62 of the trench body 51. Tile or the like (not shown) may then be laid over the waterproof membrane 56 and around the trench drain apparatus 50. A drain cover 61 may then be inserted into the opening of the trench body 51, and a leak-proof connection from the trench drain hole 54 to the drainage pipe opening 55 is established using known shower-base-installation components, as will be understood by persons skilled in this art. For example, see U.S. Pat. Nos. 8,474,068 and 8,230,535, the entire disclosures of which are incorporated herein by reference.

Figure 2:
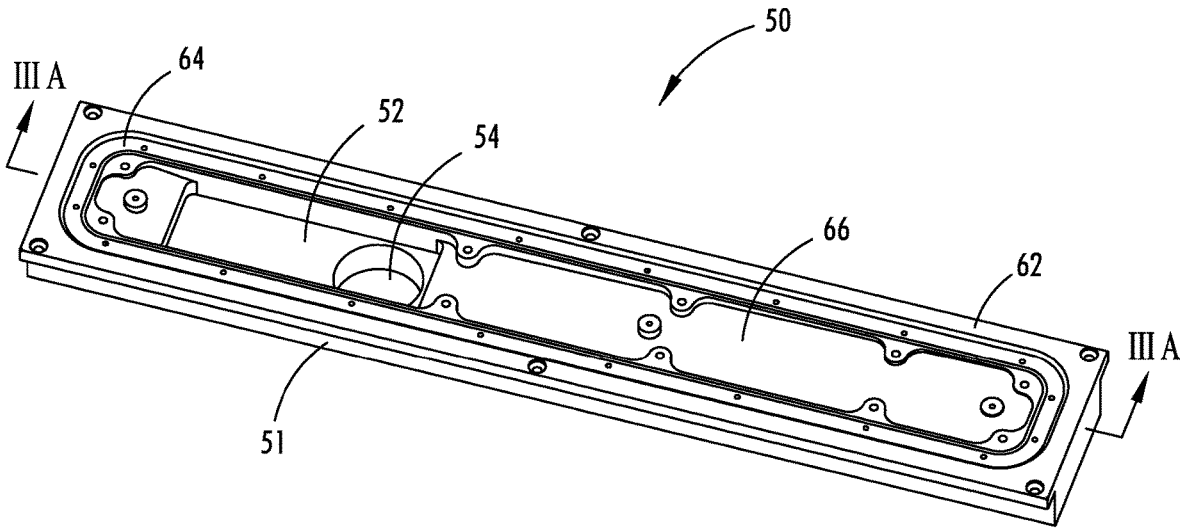
FIG. 2 is a top orthogonal view of the trench drain apparatus of FIG. 1 with the insert positioned in a second position.
Figure 3:
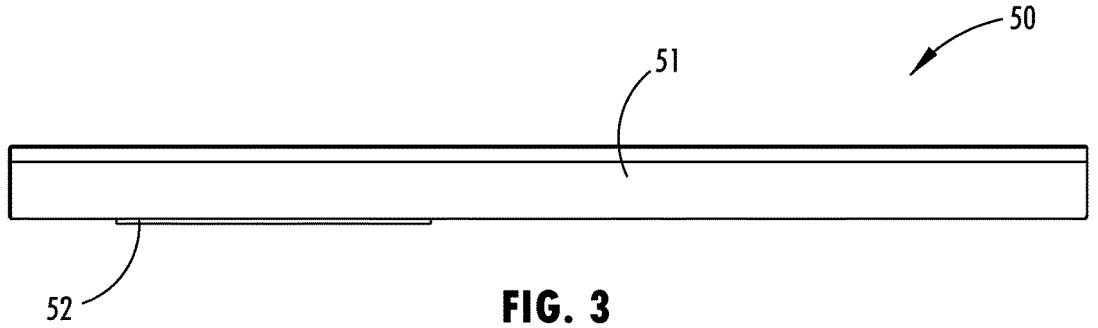
FIG. 3 is an elevational view of the trench drain apparatus of FIG. 1.
Figure 3A:
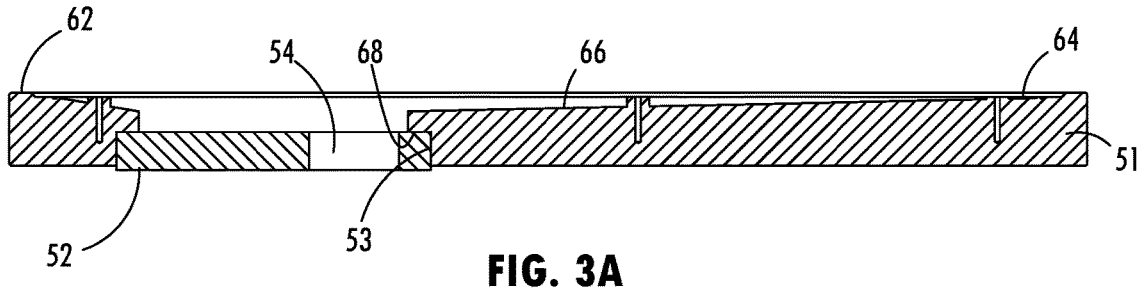
FIG. 3A is a cross-sectional view of the trench drain apparatus of FIG. 1 taken along line IIIA-IIIA in FIG. 2.
Figure 4:
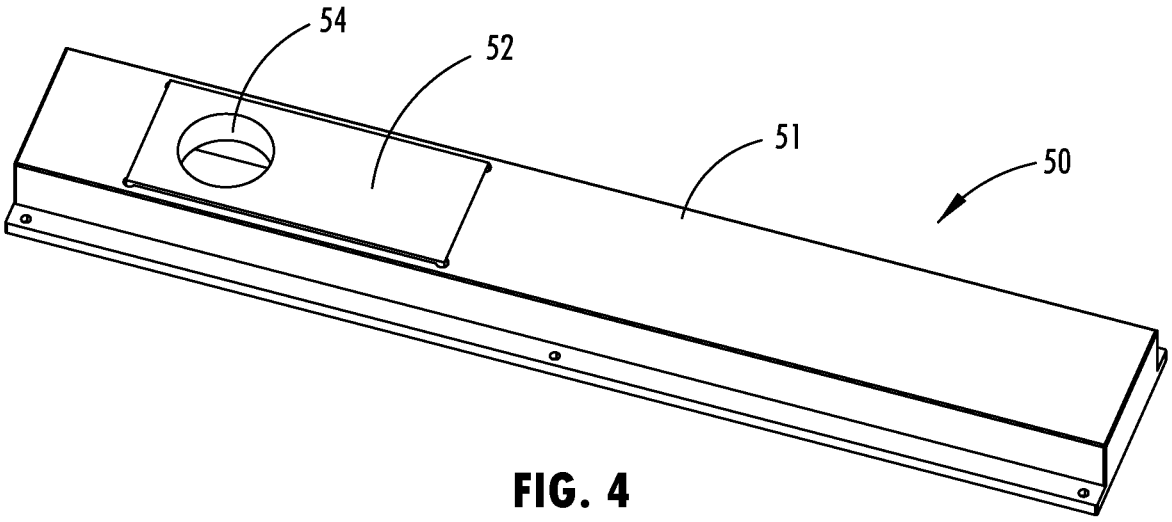
FIG. 4 is a bottom orthogonal view of the trench drain apparatus of FIG. 1 with the insert positioned in a first position.
Figure 5:
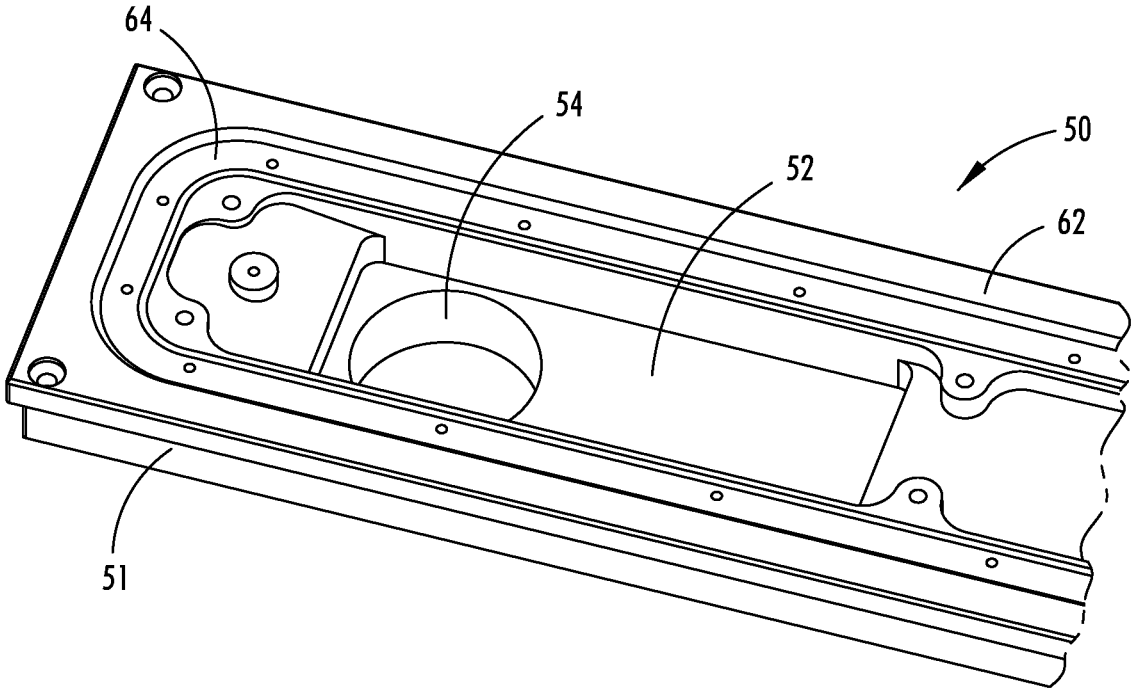
FIG. 5 is an enlarged view of a portion of the trench drain apparatus of FIG. 1 with the insert positioned in a first position.
Figure 6:
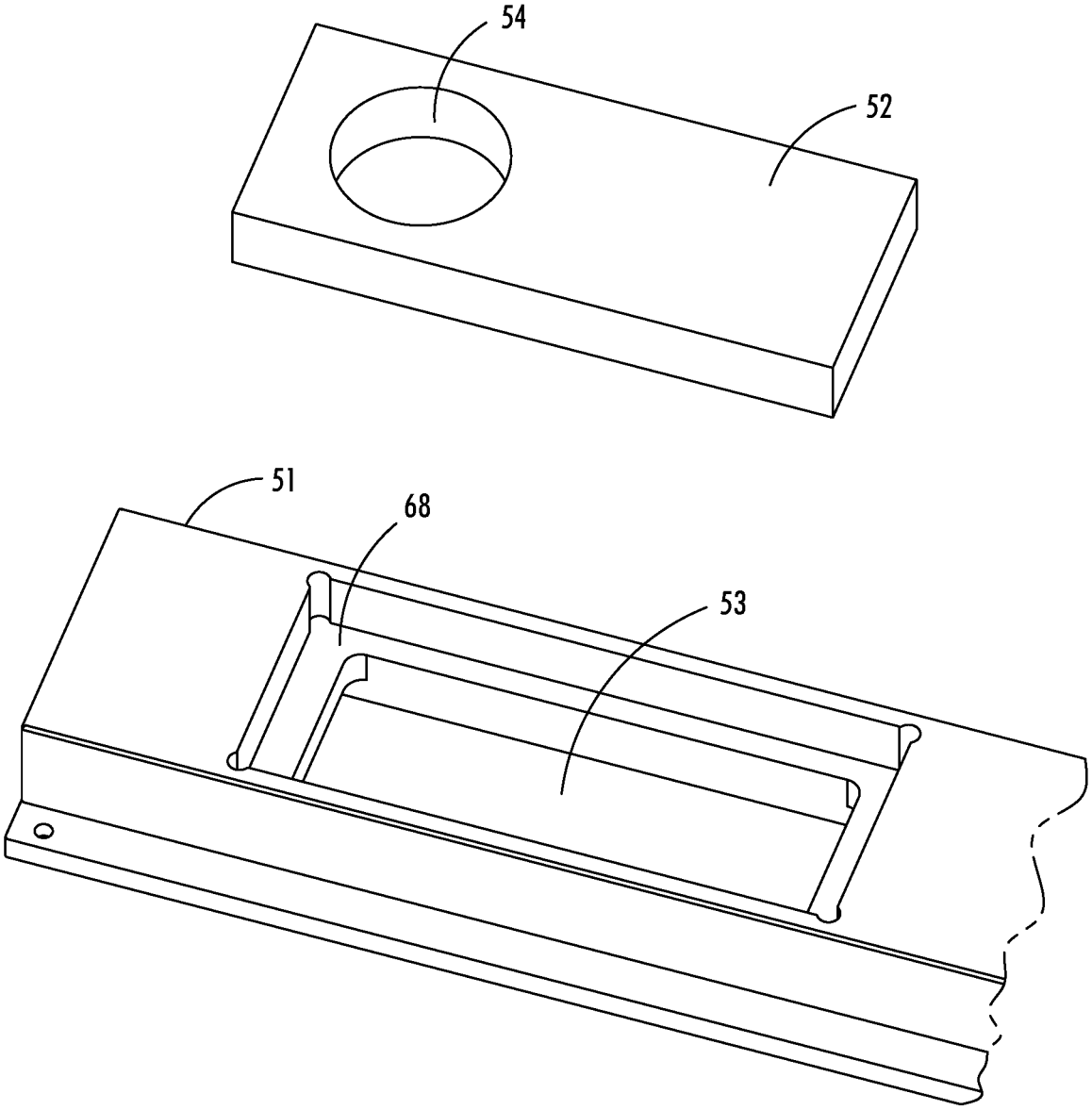
FIG. 6 is an exploded enlarged bottom view of the trench drain apparatus of FIG. 1 with the insert positioned in a first position.
Figure 7:
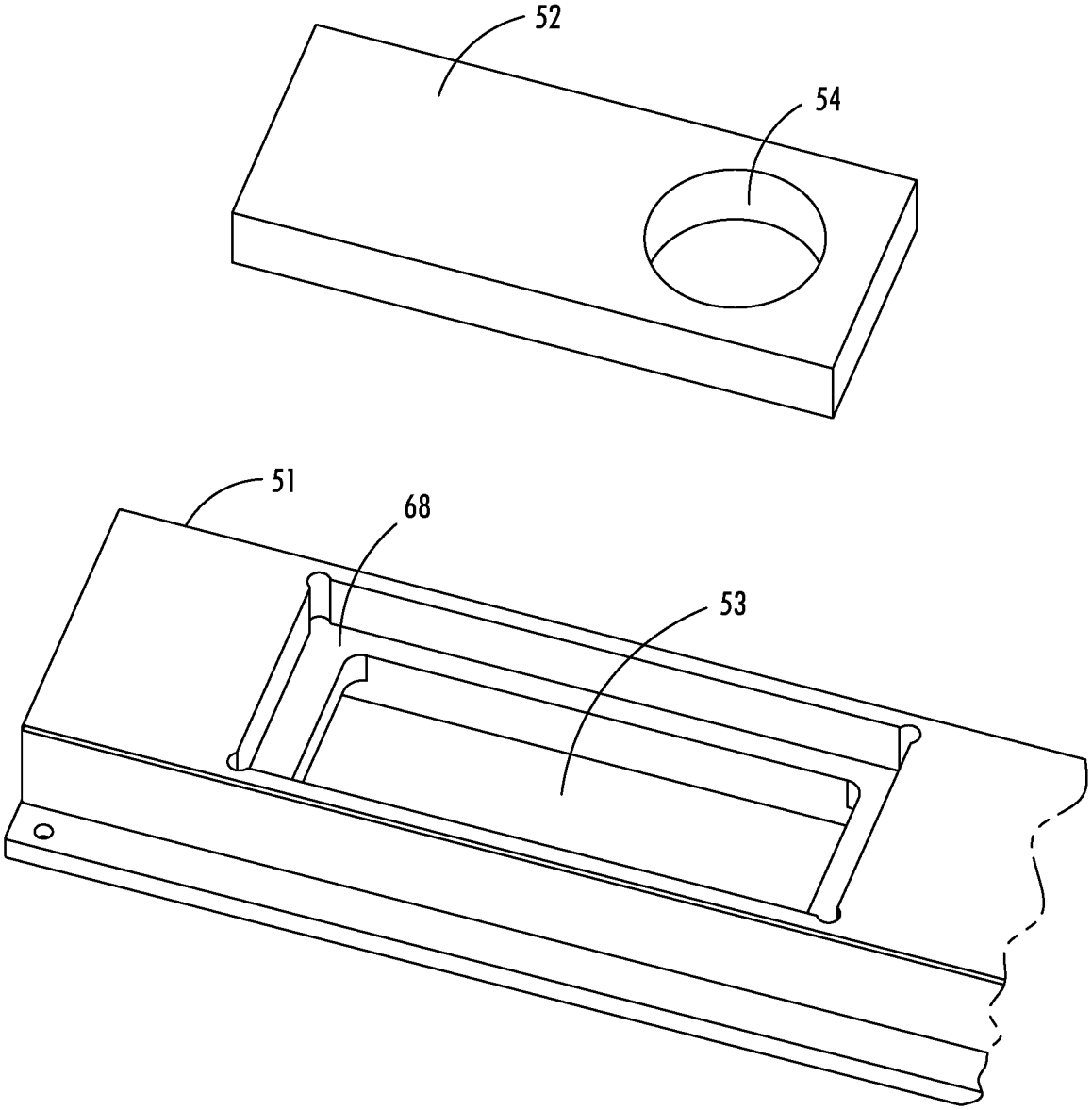
FIG. 7 is an exploded enlarged bottom view of the trench drain apparatus of FIG. 1 with the insert positioned in a second position.
Figure 8:
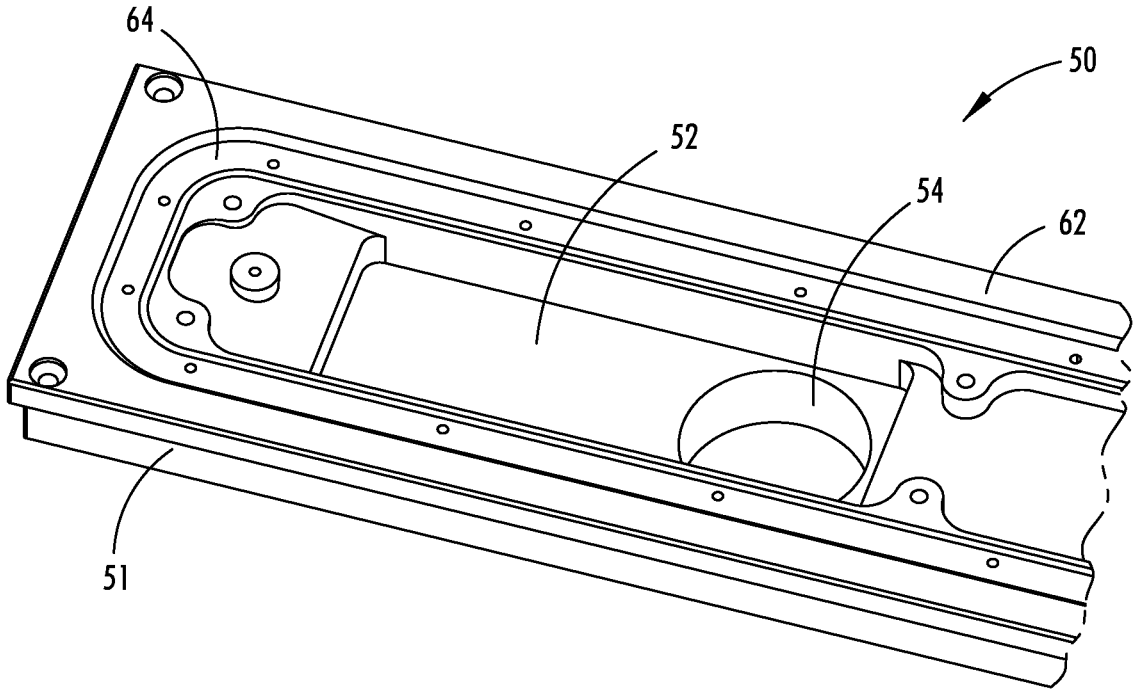
FIG. 8 is an enlarged view of a portion of the trench drain apparatus of FIG. 1 with the insert positioned in a second position.
Figure 9:
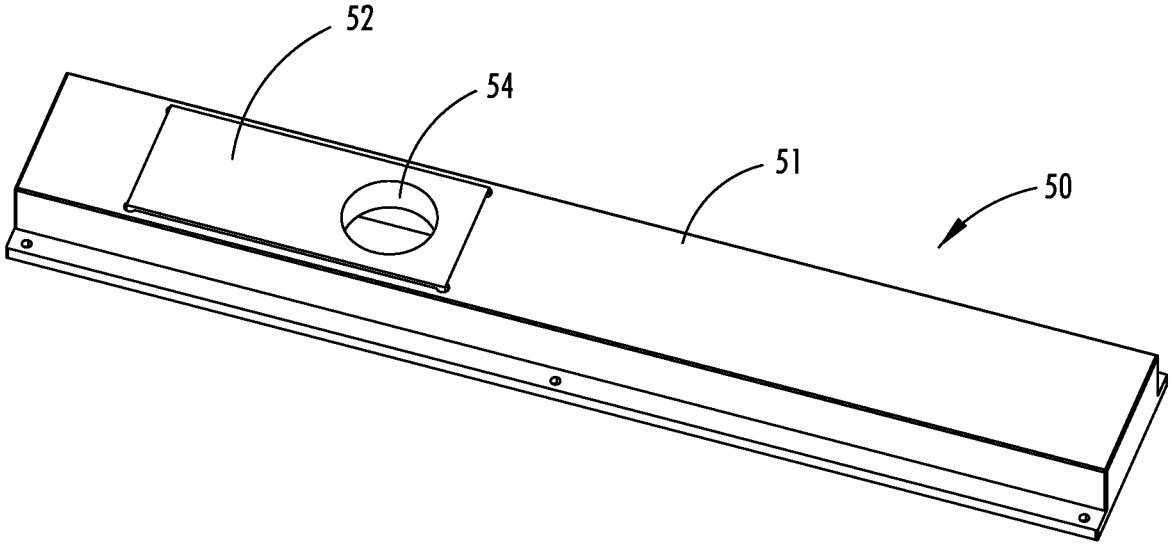
FIG. 9 is a bottom orthogonal view of the trench drain apparatus of FIG. 1 with the insert positioned in a second position.

FIGS. 1, 1A, 4, 5, and 6 show the insert 52 in a first orientation with the trench drain hole 54 close to an end of the trench body 51, whereas FIGS. 2, 3, 3A, and 7-9 show the insert 52 in a second orientation with the trench drain hole 54 further from the end of the trench body 51. As best shown in FIGS. 6 and 7, the insert 52 has a length with a longitudinal center and the trench drain hole 54 is offset from the longitudinal center. In this way, the insert 52 may be provided at one of two 180 degrees different orientations in the cavity 53 of the trench body 51. The cavity 53 is elongated and the insert 52 is similarly elongated so that the insert matingly fits into the cavity 53 with outboard portions of the insert 52 closely adjacent mating inboard portions of the trench body 51 surrounding the cavity 53. The cavity 53 also defines a continuous cross-sectional shape, and the insert 52 also defines a corresponding cross-sectional shape generally matching the cross-sectional shape of the cavity 53. The insert 52 may fit into a bottom of the cavity 53. As shown in FIGS. 3A, 6, and 7, the trench body 51 may include abutment ledges 68 that abut an upper surface of the insert 52 when the insert is positioned in the cavity 53. The abutment ledges 68 may be located at a depth within the cavity 53 that corresponds to a thickness of the insert 52 so that a bottom surface of the insert 52 is generally co-planar with a bottom surface of the trench body 51. Although the insert 52 is shown as having a continuous cross-section and having a thickness corresponding to the depth of the abutment ledges 68, the insert could have a thinner body with a protruding neck that connects to the drainage pipe instead of the insert having one consistent thickness throughout the length.

As noted above and shown in FIGS. 2 and 3A, the trench body 51 has a recessed ledge 64. Inside of the recessed ledge 64 is a sloped surface 66 that extends and slopes toward the cavity 53 for directing gravity-biased water toward the cavity 53.

One method of assembly of the trench drain apparatus 50 of FIGS. 2 and 10 includes forming the trench body 51 and the insert 52 (with the insert 52 being longer than the cavity 53 in the trench body 51), cutting the insert 52 along a cut line 52*a* to selectively adjustably locate the trench drain hole 54, and bonding the insert 52 in the trench body 51 to form a leak-free assembly. In another method, the insert 52 is manufactured to an accurate length with the trench drain hole 54 in an offset position, and then the insert 52 is installed to locate the (offset) drain hole 54 in a preferred location. In yet another method, the insert 52 is first manufactured and then the drain hole 54 is drilled into the insert 52, after which the insert 52 is placed into the cavity 53 of the trench body 51.

It is noted that the illustrated system may be embodied using an insert 52 that can be cut to a desired length, with ends being cut so that the drain hole 54 ends up at a desired location. This allows optimal alignment of the trench drain hole 54 with the drainage pipe opening 55. Also mentioned above was the fact that a precut insert 52 can be rotated 180 degrees before installation into the trench body 51 in order to change the location of the drain hole 54. However, it is contemplated that there are other arrangements that could be constructed to provide an adjustable-drain-opening system. In a first example, the body could have a round cavity (instead of the illustrated rectangular cavity), and the insert could have a matching round shape (instead of the illustrated rectangular shape). In this variation, the drain hole in the insert would be offset from a center-point of the insert. As the insert is rotated in the round cavity, the drain hole moves to different selected offset (adjusted) positions. For example, in a second example, the body could be rectangular and the insert rectangular, but instead of cutting ends of an elongated (too long) insert, additional filler blocks could be provided that take up (fill) space left open by a (too short) insert.

The present innovation is believed to be the first system providing a selective variable-location-drain-hole, where the system utilizes pre-manufactured components, yet allows on-site flexibility and variability in matching/aligning with a drainage pipe opening. The present apparatus can be useful in new constructions as well as upgrade and retrofit constructions.

Although an optional waterproof membrane 56 is described above along with the clamp ring 57, it may be possible to use liquid waterproofing instead of the membrane 56 and the associated clamp ring 57.

It should be understood that although the above description and the drawings show the cavity 53 located near one of the ends of the trench body 51, the cavity 53 may alternatively be located at or near the center of the trench body 51.

It will be understood by one having ordinary skill in the art that construction of the described device and other components is not limited to any specific material. Other exemplary embodiments of the device disclosed herein may be formed from a wide variety of materials, unless described otherwise herein.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other known processes or steps to form structures within the scope of the present device. The exemplary structures and processes disclosed herein are for illustrative purposes and are not to be construed as limiting.

It is to be understood that variations and modifications can be made on the aforementioned structure without departing from the concepts of the present invention, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A trench drain apparatus, comprising:

a trench body having a foot print when in an installed position and defining a cavity that is upwardly and downwardly open when in the installed position; and an insert defining a trench drain hole, the insert being configured to be fit entirely within the cavity of the trench body to adjustably locate the trench drain hole relative to the foot print of the trench body, wherein the cavity is elongated and defines a cavity length, and the insert is also elongated and defines an insert length greater than the cavity length such that the insert is cut to the cavity length to adjust the position of the trench drain hole relative to the trench body.

2. The trench drain apparatus of claim 1, wherein the trench body has an upper surface around the cavity that is adapted to receive a waterproof membrane and a clamp ring for clamping the waterproof membrane onto the upper surface.

3. The trench drain apparatus of claim 1, wherein the cavity is elongated and defines a continuous cross-sectional shape, and the insert is also elongated and defines a corresponding cross-sectional shape generally matching the cross-sectional shape of the cavity.

4. The trench drain apparatus of claim 1, wherein the insert fits into a bottom of the cavity.

5. The trench drain apparatus of claim 4, wherein the trench body includes abutment ledges that abut an upper surface of the insert when the insert is positioned in the cavity.

6. The trench drain apparatus of claim 5, wherein the abutment ledges are located at a depth within the cavity that corresponds to a thickness of the insert so that a bottom surface of the insert is generally co-planar with a bottom surface of the trench body.

7. The trench drain apparatus of claim 1, wherein the insert has a length with a longitudinal center and the trench drain hole is offset from the longitudinal center.

8. An adjustable-drain-location-defining system for a moisture-laden environment with a floor drain, comprising:

a trench body defining a cavity that is upwardly and downwardly open when in an installed position; and an insert shaped to matingly and adjustably fit into the cavity, the insert defining a drain hole that is adjustably located in the trench body relative to a foot print of the trench body when the insert is assembled to the trench body, wherein the insert fits into a bottom of the cavity on the underside of the trench body.

9. The system of claim 8, wherein the trench body includes an upper surface configured to receive a waterproof membrane and a clamp ring for holding the waterproof membrane on the upper surface.

10. The system of claim 8, wherein the trench body further includes a sloped surface that extends toward the cavity for directing gravity-biased water toward the cavity.

11. The system of claim 8, wherein the trench body includes abutment ledges that abut an upper surface of the insert when the insert is positioned in the cavity.

12. The system of claim 11, wherein the abutment ledges are located at a depth within the cavity that corresponds to a thickness of the insert so that a bottom surface of the insert is generally co-planar with a bottom surface of the trench body.

13. The system of claim 8, wherein the insert has a length with a longitudinal center and the trench drain hole is offset from the longitudinal center.

14. A method of placing a trench drain opening in a desired location, comprising:

providing a trench body defining a footprint when installed and having a cavity that is upwardly and downwardly open when in the installed position;

providing an insert defining a trench drain hole;

cutting the insert to a length that fits within the cavity of the trench body such that the trench drain hole is adjustably located relative to the trench body; and assembling the insert to the trench body to adjustably locate the trench drain hole relative to the foot print of the trench body.

15. The method of claim 14, wherein the insert has a length with a longitudinal center and the trench drain hole is offset from the longitudinal center.

16. The method of claim 14, wherein the trench body includes an upper surface configured to receive a waterproof membrane and a clamp ring for holding the waterproof membrane on the upper surface.

17. A method of placing a drain opening in a desired location to match a drainage pipe, comprising:

providing a body defining a footprint when installed and having a cavity that is upwardly and downwardly open when in the installed position;

providing an insert defining a drain hole;

adjustably assembling the insert to the body to adjustably locate the drain hole on the body; and coupling the insert into a bottom of the cavity from the underside of the body to form a leak-free assembly around the insert and the body.

18. The method of claim 17, wherein the insert has a center and the drain hole is offset from the center.

19. The method of claim 17, further comprising cutting the insert to a length that fits within the cavity of the body such that the drain hole is adjustably located relative to the body.

* * * * *